US005940883A

United States Patent [19]

Daoust

[11] Patent Number: 5,940,883

[45] Date of Patent: Aug. 24, 1999

[54] VETERINARIAN VEST/BELT ASSEMBLY

[76] Inventor: Dennis S. Daoust, 17084 Lime Kiln Rd., Sonora, Calif. 95370

[21] Appl. No.: 09/002,286

[22] Filed: Dec. 31, 1997

[51] Int. Cl.[6] ..... A41D 1/04

[52] U.S. Cl. ..... 2/102; 2/94; 2/311; 224/901

[58] Field of Search ..... 2/102, 94, 85, 2/93, 108, 247–250, 311–312, 338; 224/901, 918, 919, 904, 222–226, 232, 234, 249, 251, 272

[56] References Cited

U.S. PATENT DOCUMENTS

| | | | |
|---|---|---|---|
| D. 348,565 | 7/1994 | Cummins | 2/901 |
| 2,678,447 | 5/1954 | Braeken | 2/94 |
| 3,664,560 | 5/1972 | Perkins | 2/312 |
| 4,106,121 | 8/1978 | Belson | 2/102 |
| 4,369,526 | 1/1983 | Clutts | 2/102 |
| 4,637,075 | 1/1987 | Ingrisano et al. | 2/94 |
| 5,072,456 | 12/1991 | Elin | 2/94 |
| 5,265,782 | 11/1993 | McNamara | 2/94 |
| 5,526,535 | 6/1996 | Dobrzenski | 2/94 |
| 5,568,887 | 10/1996 | Gollihue et al. | 224/222 X |

*Primary Examiner*—Gloria Hale
*Attorney, Agent, or Firm*—Perkins, Smith & Cohen, LLP; Jacob N. Erlich; Jerry Cohen

[57] ABSTRACT

An apparel and belt assembly for use by a range veterinarian, the apparel and belt assembly having a plurality of item storing members thereon. The item storing members being strategically located with respect to each other and in some instances enabling the items stored therein to interact with one another. By using the apparel, preferably in the form of a vest alone or in conjunction with the belt, it is possible for the range veterinarian to work more efficiently and effectively while treating animals, especially in the field.

20 Claims, 6 Drawing Sheets

VETERINARIAN VEST/BELT ASSEMBLY

BACKGROUND OF THE INVENTION

This invention relates generally to garments for holding articles therein, and, more particularly, to a vest/belt for use by veterinarians on the range to store their supplies and medical paraphernalia for easy access while treating and tending animals in the range.

In recent years, more emphasis has been placed in the cattle business on the prevention and treatment of illness in cattle. Thus, over the last few years, cattle have been produced which are healthier and of better quality. In particular, the range cattle business has also improved as a result of better fencing, better feed utilization and as stated above, better treatment and care of cattle.

Today's cattle ranchers tend to the cattle by using modern four wheel vehicles as well as horses. It has been a constant challenge to better equip range veterinarians for the doctoring and treatment of cattle under range conditions. In the past, range veterinarians used an assortment of small bags, boxes and the few small pockets in jackets to store their equipment while in the field. It has become more important for the needed medical equipment to be readily accessible by the range veterinarian for the treatment of cattle in the field.

As stated above, for years such medical equipment was held in medicine bags or saddle bags, etc. on horses and therefore the equipment was subject to being damaged as well as relatively difficult to access during time of needs. In the fast moving world of range veterinarians, the handling and accessibility of the equipment still remains much the same way as it was in years past. There is a definite need by the range veterinarian for equipment capability which enables the range veterinarian to store their medical equipment in a safe, yet easily accessible location.

It is therefore an object of this invention to provide a vest for use by veterinarians in the treatment of animals on the range.

It is another object of this invention to provide a belt assembly for use by veterinarians in the treatment of animals on the range.

It is still a further object of this invention to provide a vest/belt assembly combination which provides a range veterinarian to easy access to his or her supplies and medical paraphernalia.

It is an even further object of this invention to provide a vest/belt assembly which is rugged in construction and capable of being easily manufactured.

SUMMARY OF THE INVENTION

The objects set forth above as well as further and other objects and advantages of the present invention are achieved by the embodiments of the invention described herein below.

The present invention provides a veterinarian who treats animals on the range with a vest and belt assembly which are capable of storing a plurality of articles or items to be used by the veterinarian during the treatment of the animals. The storage devices which are affixed to both the vest and the belt are uniquely designed and located in specific preselected positions of the vest and/or belt assembly such that during the treatment of animals on the range the articles are easily accessible to the veterinarian. In addition, the construction of the storage devices, vest and belt are is extremely rugged, incorporating therein reinforcements to prevent damage to the articles as well as the user. Furthermore, preselected storage devices work in conjunction with one another to enable some of the articles contained therein to work in combination with another. For example, the storage of a medicine container permits a self-loaded vaccine gun which has a tube attached thereto to be located in an adjacent storage device and work in conjunction with the contents of the medicine container without removing the medicine container. Even further, other articles used in the treatment of animals on the range, such as new and used hypodermic needles, can be easily stored within the vest without damaging the vest or injuring the user.

The vest also contains a series of uniquely designed pocket-like members which contain therein other articles used during the treatment of animals such as crayons or chalk for marking of livestock, buluse guns for dispensing large bovine pills, buluses (large bovine pills), and an assortment of other veterinarian articles of use. The vest also contains pockets both on the front and rear for additional articles as well as serving as hand warmers.

The belt assembly, which can be used in combination with the vest or by itself, also contains a series of item holding members, including specially designed holsters for supporting automatic vaccine guns, bottles of vaccine and other types of articles for easy access by the veterinarian.

The vest/belt assembly of the present invention, although ideally suited and primarily used by veterinarians whose main purpose is the treatment of livestock on the range, can also be used by others in numerous types of environments.

For a better understanding of the present invention, together with other and further objects thereof, reference is made to the accompanying drawings and detailed description, and its scope will be pointed out in the appended claims.

DETAILED DESCRIPTION OF THE PREFERRED EMBODIMENTS

Figure 1:
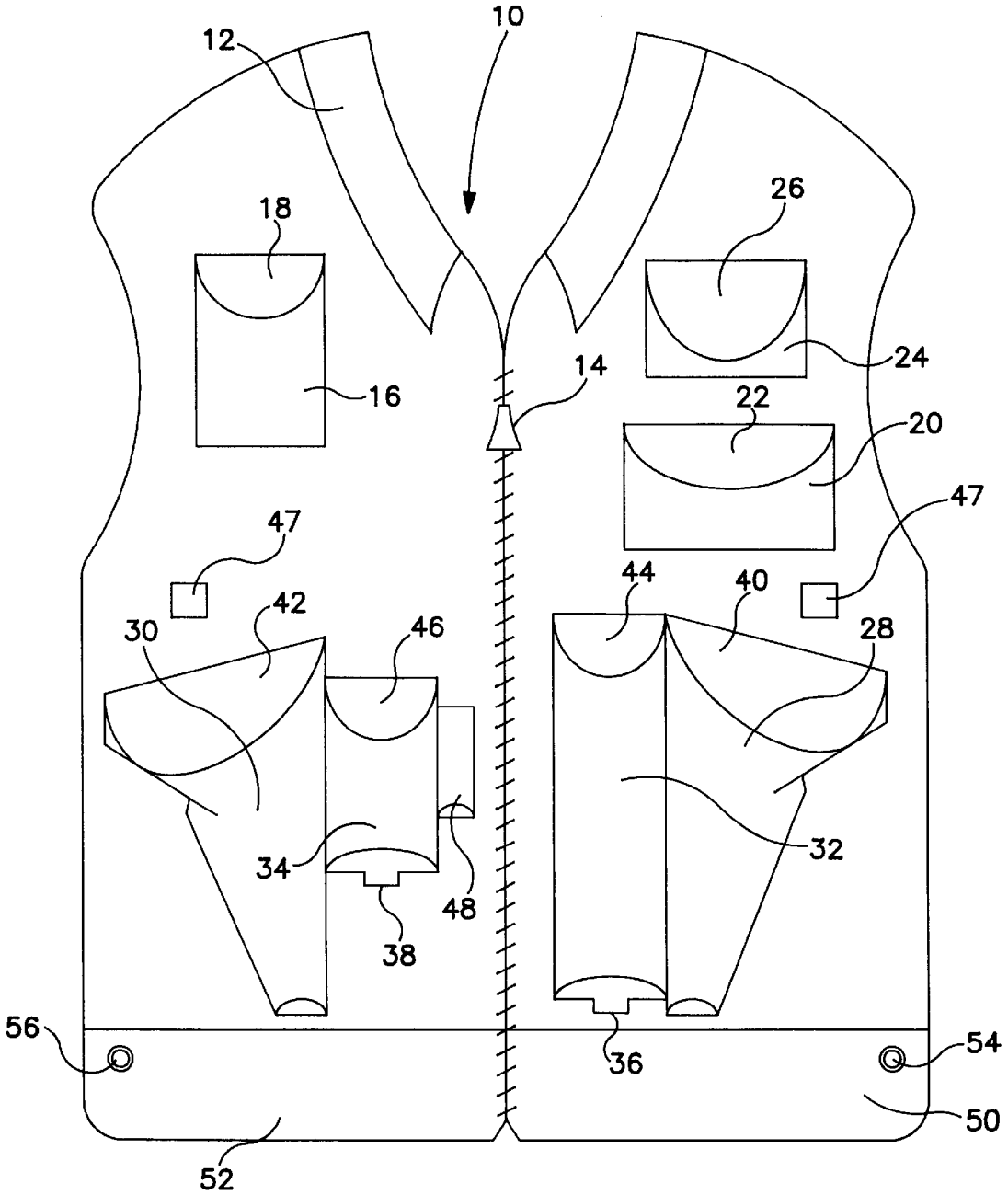
FIG. 1 is a front view of the vest of this invention clearly depicting the uniquely designed item holding members in place thereon.

It should be noted that in the following description of the present invention similar components will be identified with identical reference numerous throughout the drawings and description. In addition, preferred dimensions will be provided throughout the description, although it should be realized that these dimensions can be varied and still fall within the scope of this invention Reference is now made to FIG. 1 of the drawings which clearly depicts the front view of a vest 10 or similar garment preferably utilized by veterinarians who treat livestock on the range or under field conditions. The vest 10 preferably is sleeveless, although sleeves formed either integral with the vest body or removable therefrom can also be part of the vest of this invention. Vest 10 preferably has a V-shaped neck configuration with a soft fabric collar 12 surrounding the V neck. Although numerous materials can be utilized in the manufacture of vest 10, it is preferable that vest 10 be made of a cotton, duck material having a zippered front. The utilization of zipper 14 enables the vest to be easily placed in position upon or removed from the body of the user.

It is a major part of this invention for vest 10 to removably contain thereon,.in a plurality of item storing members or compartments located in preselected positions upon the front and back of the vest, a series of items designed for use by a range veterinarian or the like. More specifically, in an uppermost portion of vest 10, a pocket 16 is positioned so as to enable the veterinarian or user of the vest to easily place a daily tally book therein. This pocket 16, 4½×6" for example, incorporates therein a flap-type closure element 18 which can be secured to the pocket 16 by any suitable fastening means such as VELCRO® hook and loop fastener or any other hook and loop fastener (not shown). In addition, it is desirable to place in the mid or upper-mid portion of the vest 10 an item holding member 20, 3×4½" for example, capable of providing space for and easy accessibility to individual new hypodermic needles which may be located within their own individual cases. This item containing member 20 also has a flap 22 which can be held in the closed position by any suitable fastening means such as Velcro®. Located above the needle holding member 20, in an out-of-the-way location, is a cushion 24, 2½×3½" for example, for holding used hypodermic needles in an out-of-the-way position so as not to injure the veterinarian or user of the vest. This used needle cushion 24 may also have a cover 26 which is preferably made of a strong material such as, for example, a leather backing so as to protect the user from accidental injury from the used needles.

In a more central location on vest 10 are item holders used by the veterinarian on a regular basis and therefore must be easily and rapidly accessible by the user. For example, on both the left and right sides of the vest 10, holders 28 and 30, respectively, are positioned for removably housing self-loading vaccine guns. These holders 28 and 30 are positioned adjacent vaccine or medicine dispenser holders 32 and 34, 4×7" for example, which are used to hold a 500 cc worming vaccine, for example. The holders 32 and 34 are used in a conjunction with the vaccine gun holders 28 and 30, respectively. More specifically, each of the self-loading vaccine guns have attached thereto a tube (not shown) through which the vaccine or medicine is fed from the vaccine or medicine dispensers to the vaccine guns.

As shown in FIG. 1 of the drawings, the bottoms of both the vaccine gun holders 28 and 30 and the vaccine medication holders 32 and 34 are made of a material such as leather which prevents wear. In addition, the medication holders 32 and 34 have openings 36 and 38, respectively, within the leather bottoms to enable the nipples of the medicine containers (not shown) to protrude therethrough. This permits the hose of the vaccine or medication guns to be easily attached to the nipples of these containers. The veterinarian can therefore use the vaccine gun without removing the medicine or vaccine containers from the vest. Each of the item containing members 28, 30, 32 and 34 have flaps 40, 42, 44 and 46, respectively, associated therewith utilized to hold the items within the item containing members. These flaps also can have securing means such as Velcro® affixed thereto to close the holders. Another securing means 47 can be positioned adjacent to and above the flaps to hold the flaps open when removing the vaccine gun, for example, from its holder. A small elongated pocket 48, 1½×4" for example, is also positioned centrally within the vest to contain a crayon or other similar marking device used to mark livestock.

In order to permit the veterinarian to warm his or her hands while wearing the vest 10, a pair of horizontal pockets 50 and 52, preferably lined with fleece or the like, are positioned at the bottom of the vest. These pockets 50 and 52 can also be used to store items as well as acting as hand warmers. Snaps 54 and 56 or other suitable fastening means can be used to affix the pockets to the body of the vest to close the ends of the pockets.

Figure 2:
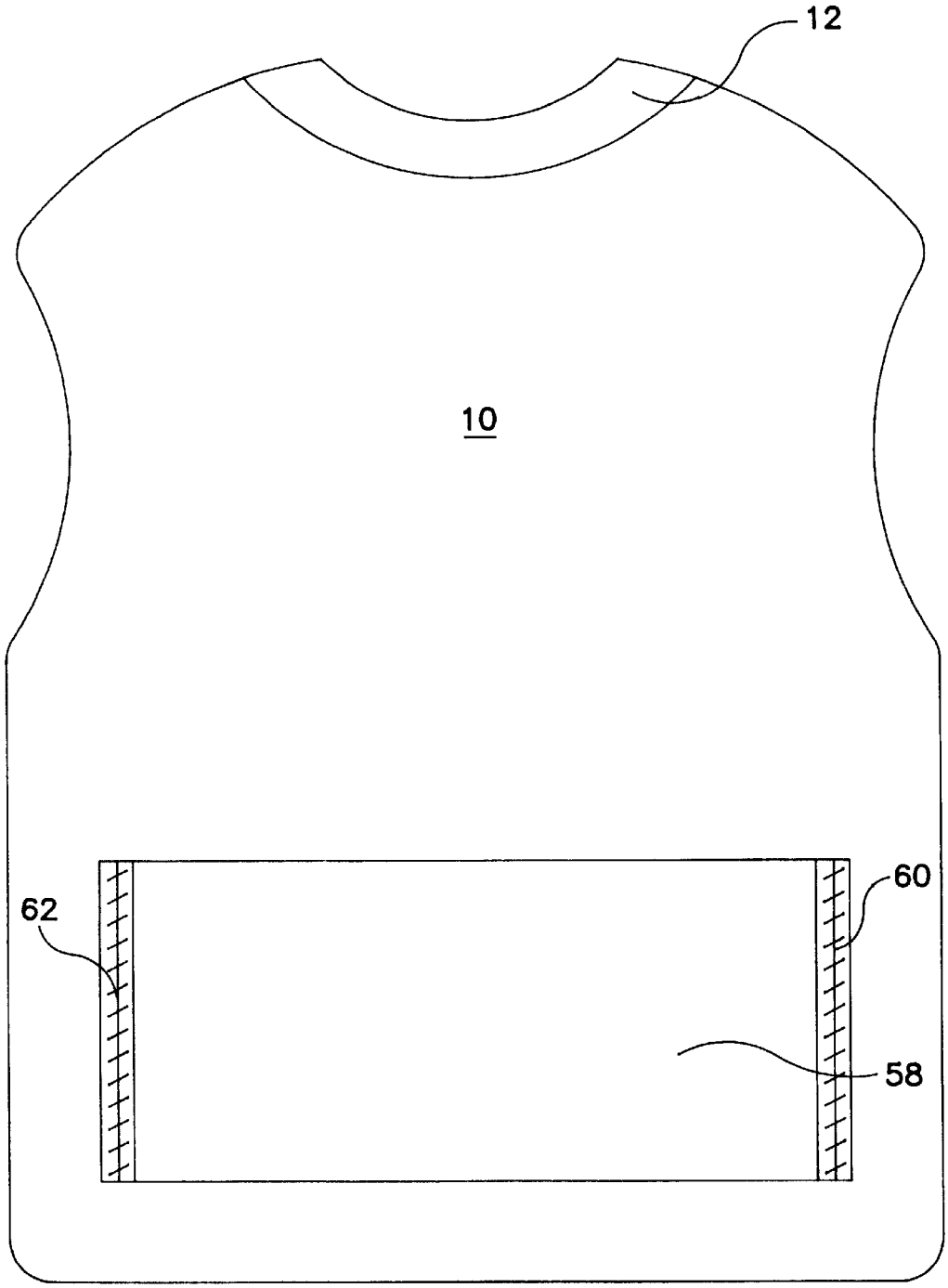
FIG. 2 is a back view of the vest depicted in FIG. 1.

The rear of vest 10 is illustrated in FIG. 2 of the drawings and shows an additional pocket 58 having zippers 60 and 62 on each end thereof for storing in an out-of-way position on vest 10 other articles used less regularly by the veterinarian.

Figure 3:
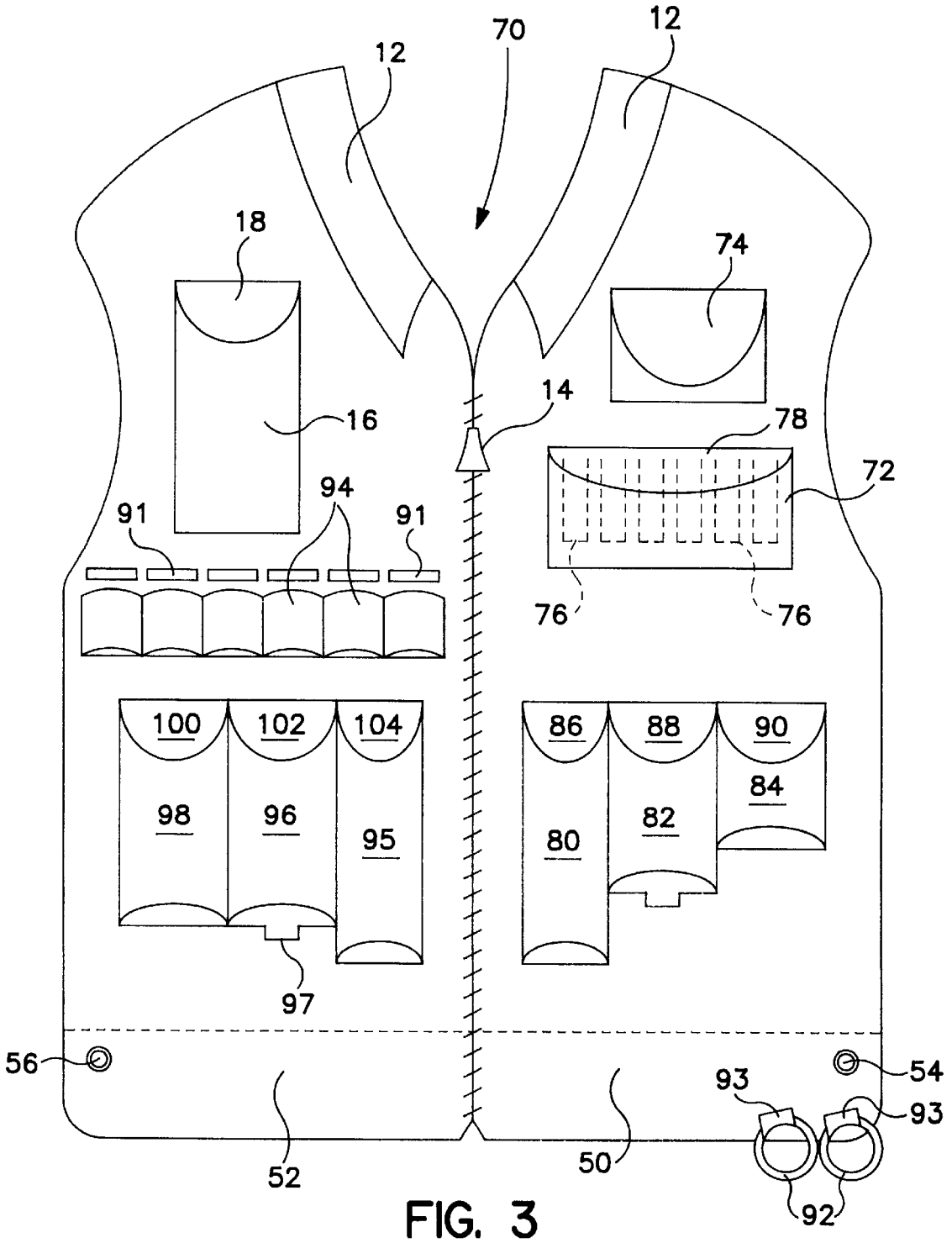
FIG. 3 is a front view of an alternate embodiment of the vest of this invention clearly depicting the item storage members thereon.
Figure 4:
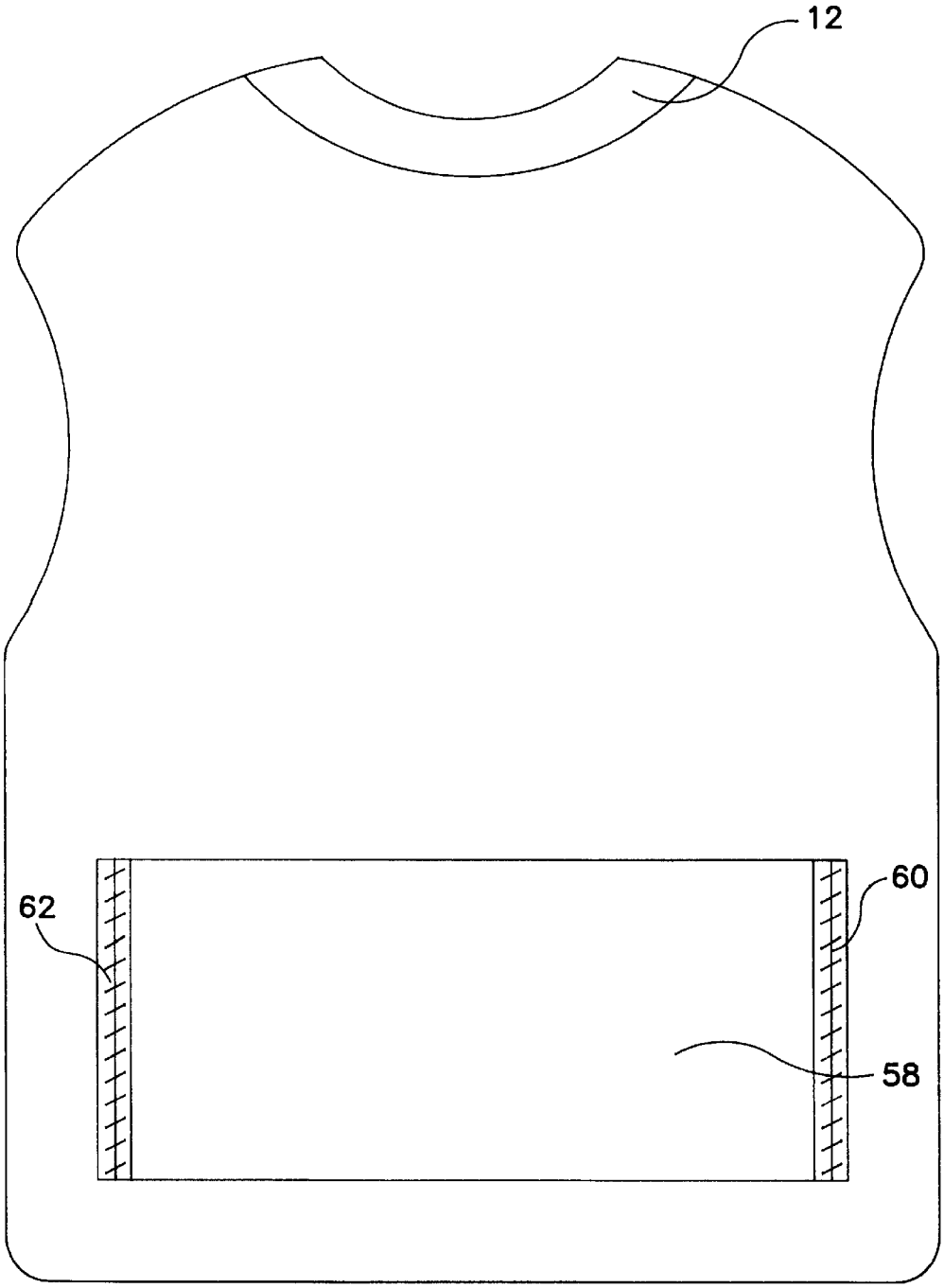
FIG. 4 is a back view of the alternate embodiment of the vest depicted in FIG. 3.

Reference is now made to FIGS. 3 and 4 of the drawings which illustrate an alternate embodiment of this invention in the form of vest 70. In describing vest 70, for simplicity, like components of vest 70 to those set forth with respect to vest 19 depicted in FIGS. 1 and 2 are given identical numerals in FIGS. 3 and 4. In addition, it should be realized that various components utilized with the various embodiments of this invention can be interchanged in vests 10 and 70 so that for a particular purpose of the range veterinarian a vest can be provided which best suits his or her needs. As with the vest 10, the material utilized for vest 70 maybe any sturdy light weight material such as cotton, duck fabric having a zipper 14 down the center thereof.

As with the embodiment shown in FIGS. 1 and 2 of the drawings, in the upper most portion of vest 70, a pocket 16 is positioned so as to enable the veterinarian or user to easily place a daily tally book therein. This pocket 16 also incorporates therein a flap-type closure element or cover 18. On a side opposite pocket 16 are located a pocket or element 72 used to hold new hypodermic needles and a pocket or holder 74 used to hold used hypodermic needles. The new needle holder 72 is designed to hold a plurality of needles in plastic cases 76 (shown in phantom as being placed within the needle holder 72). A preferred size of needle holder 72 would be approximately 3×4½", although this size may vary within the scope of this invention. A top flap or cover 78 is affixed to the needle holder 72 and can be held in place by any suitable fastening means such as Velcro®.

The used needle holder 74 maybe in the form of a needle cushion having a leather backing which prevents injuring or sticking the person wearing the vest 70. Once the needle is used this needle maybe inserted within the needle cushion holder 74 and, if desired, although not shown in the drawing, can be also covered by any suitable flap type arrangement.

In a more easily accessible location upon the vest 70, is located a pair of holders or pockets 80 and 82, one, for example, is used for holding a typical 60 cc syringe used by a veterinarian and the other capable of holding, for example, a 250 cc bottle of suitable medicine to be used with the syringe. In both instances a strong bottom, such as made of leather, is incorporated therewith. Although the size of the syringe and bottle of medicine is set forth above it should be realized that a variety of syringes and medicine bottles can be used with the present invention. A typical size for the syringe holder 80 would be 1×7" and for the medicine bottle holder 82, 3×5½". These dimensions, although preferable, may be varied within the scope of this invention.

In addition, a special holder 84 for marking live stock is provided in the same general area on vest 70. Flaps 86, 88 and 90, respectively, are associated with holders 80, 82 and 84 to cover the items contained therein.

The positioning of the various components on the vests 10 and vest 70 maximizes the availability of the various items the range veterinarian needs while treating animals in the field. Ease of accessibility to medication and medical instruments by the veterinarian can be critical since animals, unlike a human patient, are slightly less cooperative when it comes to be treated.

Vest 70 also includes, preferably at the bottom left portion of vest 70, a plurality of rings 92, preferably made of brass, for holding boluse guns (not shown) in place. This location is more suited for right handed users. The boluse gun is used by the range veterinarian for dispensing large bovine pills (boluses) used for treating cattle. The ring configuration enables the veterinarian to easily withdraw the boluse gun from its holder and then quickly return the boluse gun to its stored location. A leather keeper 93 is utilized to keep the boluse gun in place within the rings 92.

In addition, a series of individual open pockets 94 are used to store the large pills utilized in conjunction with the boluse gun. There are a plurality of resilient holders 91, preferably made of elastic or the like, utilized in conjunction with the pill pockets 94 to hold the pills removably in place on the vest 70.

On a side of vest 70 opposite the syringe and medicine bottle holders 80 and 82, respectively, is another series of pockets or holders 95 and 96 utilized to hold additional syringes and medicine. More specifically, a 20 cc syringe, for example, can be placed within pocket 95 while a 100 cc bottle of, for example, conventional medicine to be used with the syringe can be stored within the pocket 96 adjacent thereto. These pockets or holders 95 and 96 are designed similar to the pockets utilized with vest 10 in that the bottoms thereof are made of a strong material such as leather and that the medicine dispensing pocket 96 has an opening 97 which permits the nipple of the medicine bottle to protrude therethrough. This opening also allows a hose which is attached to the syringe to engage the nipple of the medicine bottle and permit the veterinarian or user of the vest 70 to remove the syringe without removing the medicine bottle.

As with the vest 10 shown in FIGS. 1 and 2, vest 70 also contains thereon, in easily accessible locations, pocket 98 which is capable of holding a marking crayon or other suitable writing means for marking the animals or cattle being treated. It is also preferred that pockets 95,96 and 98 have closure flaps or covers 100, 102 and 104, respectively, associated therewith which can be held in place by any suitable fastening means such as Velcro®.

As with the vest 10 shown in FIGS. 1 and 2, vest 70 of FIGS. 3 and 4 also contains horizontal pockets 50 and 52, preferably lined with fleece or the like, positioned at the bottom of the vest so that the veterinarian can place his or her hands within the pockets and use the horizontal pockets as hand warmers or in order to store items therein. Any suitable fastening means such as snaps 54 and 56 are utilized to close these pockets 50 and 52.

The rear of vest 70 is illustrated in FIG. 4 of the drawings and further show a pocket 58 which has zippers 60 and 62 on each end thereof for storing other articles which are to be used by the veterinarian in an out of the way position. Also shown in FIG. 4 is the back portion of the boluse holders (rings 92) which enable the boluse gun to be held securely in place.

Figure 5:
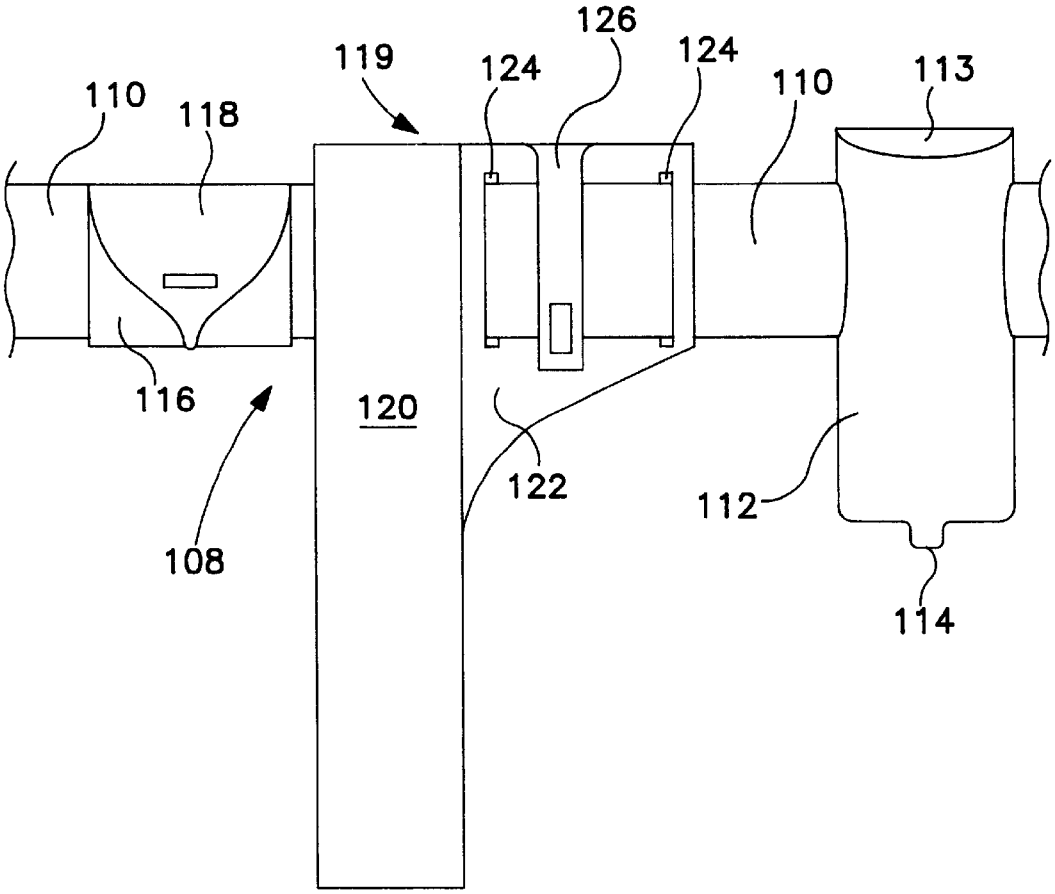
FIG. 5 is a front view of the left hand portion of the belt assembly of this invention illustrating the unique item storage members in place thereon.
Figure 6:
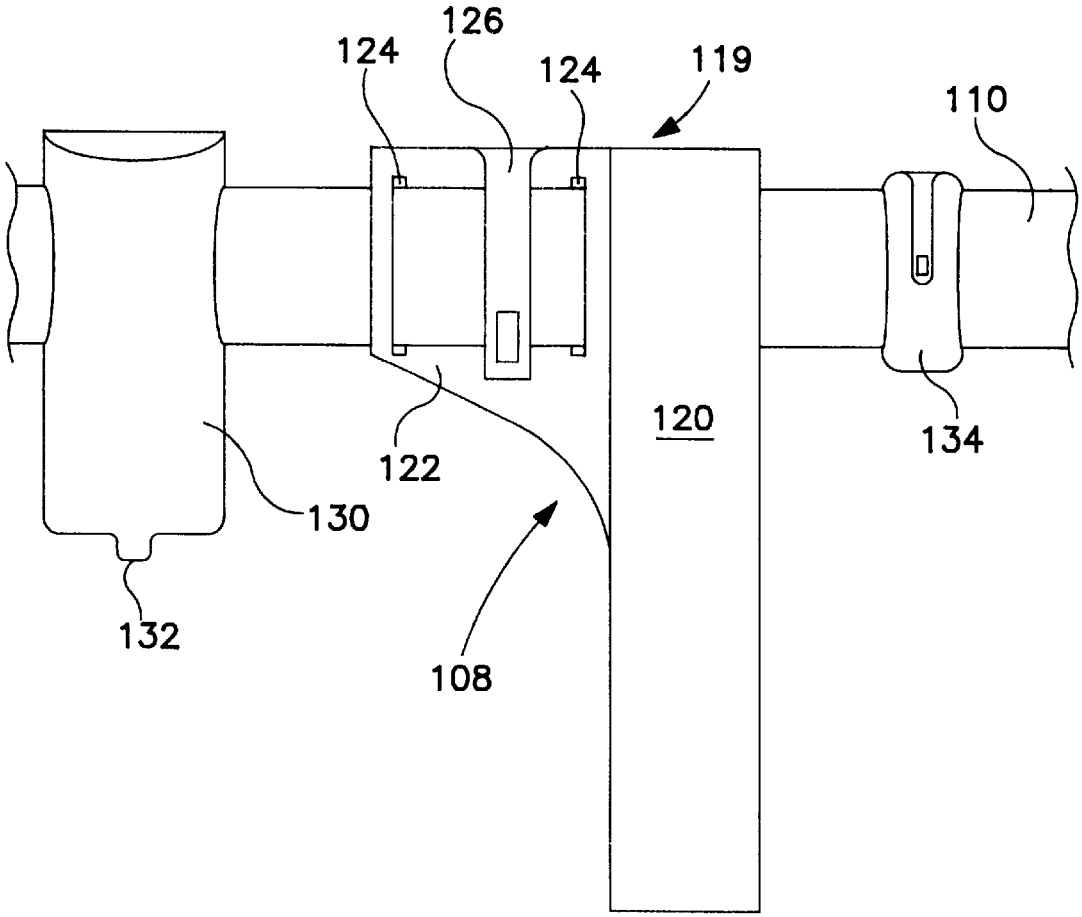
FIG. 6 is a front view of the right hand side of the belt assembly of this invention illustrating the unique item storage members in place thereon.

Reference is now made to FIGS. 5 and 6 of the drawings which show the left FIG. 5 and right FIG. 6 portions of a range veterinarian belt assembly 108 to be used in conjunction with the vests 10 and 70 or alone in the treatment of animals in the field. This embodiment of the invention provides for belt 110 to be made of any suitable material such as leather, and be preferably approximately two inches in width. This leather belt may be 44" in length and incorporate a 2" buckle (not shown) thereon. Although desirable dimensions are provided above, it should be understood that this invention is capable of altering those dimensions within the spirit and scope of this invention.

The belt assembly 108 incorporates therein a series of components in the form of pockets and holders which can be easily accessed by a range veterinarian in the field when treating animals. A pouch 112, as shown in FIG. 5 of the drawings, is preferably made of leather approximately 3½×5" in size. The pouch 112 also has a flap type cover 113 which is used in holding the vaccine bottle in place therein. The pouch 112 also has an opening 114 on the bottom thereof. The opening 114 within the pouch 112 enables the neck of the bottle to protrude therethrough. A Velcro-type® backing is utilized in conjunction with the pouch as to hold the vaccine bottle in place within the pouch. In addition, the belt 110, as shown in FIG. 5, also contains a vaccine needle pouch 116 having a top or cover 118 for storing either new or used needles in an easily accessible location.

A barrel length holster 119 made of any suitable tubular material such as a PVC pipe 120 and leather strapping 122 is used to keep the automatic vaccine gun in place on the belt. The barrel of the holster 120 is approximately 8¾" in length and its rigid material prevents damage to the vaccine gun. As with the vaccine gun utilized with a vest, a hose can be used to interconnect the vaccine gun to the medicine or vaccine dispenser located within the pouch 112. The strapping 122 has opening 124 therein which permits the belt 110 to pass therethrough. A securing strap and suitable Velcro® fastener 126 prevents the holster from moving with respect to belt 110.

A similar type of vaccine gun holster 119 is shown on the right hand portion of the belt assembly 108 in FIG. 6. The portion of the belt 110 shown in FIG. 6 also shows a leather pouch 130 having an opening 132 on the bottom thereof for a cattle wormer type medication container or the like which is usually found in a 500 cc bottle. Again it should be emphasized that the size and type of medication used with pouch 130 may be changed within the scope and intent of this invention.

Just as with vests 10 and 70, belt assembly 108 also contains a holder 134 for any type of marking instrument such as a live stock crayon having a leather strap with a Velcro® keeper to secure the marking instrument in place. The container 134 maybe made of any sturdy material such as a PVC pipe in combination with leather backing and securing material.

As is evident from an understanding of the present invention, the vests 10 and 70 can both be used in conjunction with the belt assembly 108. Further, the various types of components associated therewith can be interchangeable both in the field or prior to use within the field to accommodate the specific needs of a range veterinarian.

Although the invention has been described with respect to various embodiments, it should be realized this invention is also capable of a wide variety of further and other embodiments within the spirit and scope of the appended claims.

What is claimed is:

1. An apparel for use by a range veterinarian, said apparel comprising:

a front and a back, said front being divided into an upper portion, a middle portion and a bottom portion;

said upper portion of said front having a plurality of upper item storing members thereon, at least one of said upper item storing members capable of containing a notebook therein, another of said upper item storing members having a cushion backing associated therewith to retain used needles therein and another of said upper item storing members having a pocket for storing new needles therein;

said middle portion of said front having at least two middle item storing members thereon, said at least two of said middle storing members being interrelated with one another, one of said at least two middle item storing members having a top opening and shaped to receive an injector therein, another of said at least two middle item storing members having a top opening of predetermined size and shaped to receive a dispenser therein, said another of said middle item storing members also having a bottom opening of a predetermined size less than the predetermined size of said top opening, said predetermined size of said bottom opening being sized to permit a dispensing outlet of the dispenser to pass therethrough, wherein the dispenser and the injector are capable of being interconnected to each other to enable feeding contents of the dispenser to the injector without removing the dispenser from said another of said middle item storing members; and said bottom portion of said front having at least one horizontal pocket member capable of receiving the range veterinarian's hands therein;

whereby said apparel provides the range veterinarian with easy access to items which are located within said item storing members.

2. The apparel as defined in claim 1 wherein said bottom portion has at least one ring attached thereto, said at least one ring sized to removably hold a pill dispensing device therein and a keeper element operably connected to said ring for removably securing said pill dispensing device in place within said ring.

3. The apparel as defined in claim 1 wherein said middle portion of said front further contains a plurality of elastic pill retaining members.

4. The apparel as defined in claim 1 wherein said back contains an item storing member thereon.

5. The apparel as defined in claim 1 wherein at least one of said item storing members includes a closure element and means operably connected with said closure element for selectively holding said closure element in the open position.

6. The apparel as defined in claim 1 wherein said at least one horizontal pocket member has openings at opposite ends thereof and means associated with said ends for selectively closing the openings.

7. The apparel as defined in claim 1 being of a vest configuration.

8. The apparel as defined in claim 7 wherein said front is divided into two portions, said two portions being removably held together by a fastening element.

9. The apparel as defined in claim 8 wherein said fastening element is a zipper.

10. The apparel as defined in claim 1 wherein said middle item storing member shaped to receive an injector therein is of a holster configuration.

11. The apparel as defined in claim 1 wherein at least one of said item storing members has a bottom which is made of a material which differs from the material of the rest of the item storing member, said bottom material being of greater strength than the material of the rest of the item storing member.

12. A belt assembly for use by a range veterinarian, said belt assembly comprising:

a belt, said belt having a left portion and a right portion; and at least one of said portions having at least two item storing members interrelated with respect to one another, one of said at least two item storing members having a top opening and shaped to receive an injector therein, another of said at least two item storing members having a top opening of predetermined size and shaped to receive a dispenser therein, said another of said item storing members also having a bottom opening of a predetermined size less than the predetermined size of said top opening, said predetermined size of said bottom opening being sized to permit a dispensing outlet of the dispenser to pass therethrough, wherein the dispenser and the injector are capable of being interconnected to each other to enable feeding contents of the dispenser to the injector without removing the dispenser from said another of said item storing members.

13. The belt assembly as defined in claim 12 wherein at least one of said portions includes an item containing member configured to hold needles therein.

14. The belt assembly as defined in claim 12 wherein said one of said item storing members shaped to receive an injector therein is made of an elongated rigid tubular material.

15. The belt assembly as defined in claim 12 wherein at least one of said item storing members comprises a backing having a pair of slits therein, said slits permitting said belt to pass therethrough.

16. An item storing system for use by a range veterinarian, said item storing system comprising:

the combination of an outer apparel and a belt assembly;

said apparel having a front and a back, said front being divided into an upper portion, a middle portion and a bottom portion, said upper portion of said front having a plurality of upper item storing members thereon, at least one of said upper item storing members capable of containing a notebook therein, another of said upper item storing members having a cushion backing associated therewith to retain used needles therein and another of said upper item storing members having a pocket for storing new needles therein;

said middle portion of said front having at least two middle item storing members thereon, said at least two of said middle storing members being interrelated with one another, one of said at least two middle item storing members having a top opening and shaped to receive an injector therein, another of said at least two middle item storing members having a top opening of predetermined size and shaped to receive a dispenser therein, said another of said middle item storing members also having a bottom opening of a predetermined size less than the predetermined size of said top opening, said predetermined size of said bottom opening being sized to permit a dispensing outlet of the dispenser to pass therethrough, wherein can be the dispenser and the injector are capable of being interconnected to each other to enable feeding contents of the dispenser to the injector without removing the dispenser from said another of said middle item storing members;

said bottom portion of said front having at least one horizontal pocket member capable of receiving the range veterinarian's hands therein;

said belt having a left portion and a right portion;

at least one of said belt portions having at least two item storing members interrelated with respect to one another, one of said item storing members of said belt having a top opening and shaped to receive an injector therein, another of said at least two item storing members of said belt having a top opening of predetermined size and shaped to receive a dispenser therein, said another of said item storing members of said belt also having a bottom opening of a predetermined size less than the predetermined size of said top opening, said predetermined size of said bottom opening being sized to permit a dispensing outlet of the dispenser to pass therethrough, wherein the dispenser and the injector are capable of being interconnected to each other to enable feeding contents of the dispenser to the injector without removing the dispenser from said another of said item storing members of said belt.

17. The apparel as defined in claim 1 wherein:

said bottom portion has at least one ring attached thereto, said at least one ring sized to removably hold a pill dispensing device therein and a keeper element operably connected to said ring for removably securing said pill dispensing device in place within said ring;

said middle portion of said front contains a plurality of elastic pill retaining members:

said back contains an item storing member thereon; and at least one of said item storing members includes a closure element and means operably connected with said closure element for selectively holding said closure element in the open position.

18. The apparel as defined in claim 17 wherein said at least one horizontal pocket has openings at opposite ends thereof and means associated with said ends for selectively closing the openings.

19. The apparel as defined in claim 18 being of a vest configuration.

20. The apparel as defined in claim 19 wherein said front is divided into two portions, said two portions being removably held together by a fastening element.

* * * * *